US005550522A

United States Patent [19]

Dekkers et al.

[11] Patent Number: 5,550,522

[45] Date of Patent: Aug. 27, 1996

[54] DEFLECTION UNIT HAVING A RING WITH FIELD CORRECTION ELEMENTS, AND CATHODE RAY TUBE PROVIDED WITH SAID UNIT

[75] Inventors: Bernadus H. J. Dekkers; Ronald J. J. DeMan; Antonius J. J. Bolder; Albertus A. S. Sluyterman, all of Eindhoven, Netherlands

[73] Assignee: U.S. Phillips Corporation, New York, N.Y.

[21] Appl. No.: 414,173

[22] Filed: Mar. 29, 1995

Related U.S. Application Data

[63] Continuation of Ser. No. 149,492, Nov. 9, 1993, abandoned.

[51] Int. Cl.[6] ..... H01H 1/00; H01F 7/00; H01J 29/70; H01J 29/74

[52] U.S. Cl. ..... 335/213; 335/210; 313/431; 313/433; 313/442

[58] Field of Search ..... 335/210, 211, 335/212, 213, 214; 313/431, 433, 442

[56] References Cited

U.S. PATENT DOCUMENTS

| | | | |
|---|---|---|---|
| 3,191,104 | 6/1965 | Mak | 317/200 |
| 4,449,109 | 5/1984 | Paddock | 335/212 |
| 4,535,313 | 8/1985 | Van der Heijde | 335/212 |
| 4,782,264 | 11/1988 | Yamazaki | 313/413 |
| 4,823,046 | 4/1989 | Sluyterman | 313/431 |
| 5,117,151 | 5/1992 | Sluyterman | 313/413 |
| 5,227,753 | 7/1993 | Hirai | 335/212 |

FOREIGN PATENT DOCUMENTS

| | | | |
|---|---|---|---|
| 0135072 | 3/1985 | European Pat. Off. | H01J 29/51 |
| 2156792 | 6/1990 | Japan | H04N 9/28 |

*Primary Examiner*—Leo P. Picard
*Assistant Examiner*—Stephen T. Ryan
*Attorney, Agent, or Firm*—Robert J. Kraus

[57] ABSTRACT

An electromagnetic deflection unit (5) comprising a coil holder (6) with a flange (8) whose inner side supports coils (10*a*, 10*b*) for (line) deflection of electron beams. At the flange side of the coil holder (magnetized) preformed elements (14) are arranged within these coils so as to influence the magnetic field of these coils (10*a*, 10*b*), thereby reducing spreading errors, caused during manufacture, throughout the display screen. For the purpose of automatic mounting of the preformed elements, an annular support having predetermined locations (in particular from 12 to 36) for accommodating preformed elements is used. The preformed elements (14) are accommodated at a plurality of these predetermined locations and, if made of a permanent magnetic material, produce magnetic fields having magnetic strengths measured at a distance of some mm above the heart of the elements in the range between 1 and 1000 μT. In a special embodiment the elements of permanent magnetic material belong to a limited collection as regards their magnetic field strength.

33 Claims, 4 Drawing Sheets

DEFLECTION UNIT HAVING A RING WITH FIELD CORRECTION ELEMENTS, AND CATHODE RAY TUBE PROVIDED WITH SAID UNIT

This is a continuation of prior application Ser. No. 08/149,492, filed on 9 Nov. 1993, now abandoned.

BACKGROUND OF THE INVENTION

The invention relates to an electromagnetic deflection unit for a cathode ray tube, comprising a hollow coil holder which supports a set of coils for electron beam deflection, said coils having parts extending substantially in the longitudinal direction of the coil holder at its inner side, and field correction elements at the re-entrant side of said coils. The invention also relates to a colour display tube provided with such a deflection unit.

Such a deflection unit and a cathode ray tube (particularly a colour display tube) provided with such a unit are commercially available.

The increasingly stringent requirements which are imposed on display systems with cathode ray tubes and deflection coils lead to improved designs. However, errors always remain. These may be linearity errors, raster distortion errors (in monochrome display tubes) or convergence errors (in colour display tubes). Some of these errors are produced during manufacture due to spreading of the manufacturing process. When the tube and the coil are assembled, it is attempted in practice to correct a part of the errors which arises during manufacture by adding field correction elements which are generally in the form of preformed elements sometimes referred to as "spoilers". These elements may be made of magnetic material or of electrically conducting material (for example Al or Cu). The addition is realized locally with reference to errors found by an operator. This results in a local improvement of quality. To be able to generate a maximum possible field strength at a minimum possible power, the coils are arranged at the inner side of the coil holder in such a way that—when the deflection unit is mounted on a display tube—the coils are located as close as possible to the electron beams in the display tube. As a result of this deflection unit structure, the greater part of the preformed elements must generally be glued against the inner surface of the coils. The rather non-flat surface of the coils may bring about a poor adhesion so that the preformed elements come loose. It is conventional practice to secure soft-magnetic preformed elements by means of adhesive tape and fix them with glue.

The (manual) correct positioning and fixation of the preformed elements, which may have mutually different shapes and sizes, is time-consuming and hence expensive so that generally a relatively small number, for example, four or six is used. Generally this results only in a local improvement of the picture displayed on the screen. The results of this known method of optimization are therefore inadequate if more stringent requirements are imposed.

SUMMARY OF THE INVENTION

It is an object of the method proposed in this application to improve the quality of the picture throughout the screen.

It is a further object of the invention to provide an electromagnetic deflection unit having a construction with which the field correction elements can be positioned rapidly and preferably automatically.

In a deflection unit of the type described in the opening paragraph according to the invention this object is achieved by arranging an annular support having predetermined locations for accommodating field correction elements within the set of coils. The field correction elements are accommodated at a plurality of such predetermined locations.

"At predetermined locations" is understood to mean that one type of annular support with fixed corrector locations is used for a series of display tubes of the same type (for example colour monitor tubes having a fixed screen diagonal). The use of correctors of the permanent magnetic type, or magnetized preformed elements is preferred, and will hereinafter be described by way of example, but the invention is not limited thereto. Differences may reside in the strength (magnetic induction) and the direction of magnetization, dependent on the correction required for a given combination of display tube and deflection unit. Generally, corrections with magnetic fields having a field strength in the range between 1 and 1000 μT, may be sufficient, and in most cases corrections between 5 and 500 μT are sufficient. For providing these fields correctors are used in the form of planar elements which produce these field strengths at a certain distance above their centers, which distance is associated with the distance from the electron beams.

The exact magnetic strength and polarity of the corrector needed for each corrector location can be determined with reference to the measured error pattern followed by individual magnetization of each corrector at the desired strength (and polarity). An alternative is characterized in that the magnetized preformed elements have magnetic strengths which, while taking a given tolerance into account, have a limited number of fixed values. (For example, values which are a multiple of a given unit strength). In accordance with a further embodiment the preformed elements have an elongated (particularly rectangular) shape and have an in-plane direction of magnetization which is parallel to their short or their long axis. This provides the possibility of magnetizing all preformed elements in the same direction, while placing them in a first position or in a 180° rotated position provides a choice of two opposite polarities. The strength and the polarity of the correctors to be placed in the ring can be determined by means of a computer program with reference to the known effects of a reference corrector and the error pattern measured (for example, at 25 points on the screen). Each corrector has its own influence on the convergence pattern.

The correctors can be positioned rapidly and possibly automatically by using an annular corrector support having, for example a plurality of compartments arranged at fixed locations along a circular circumference for accommodating correctors. The larger the number of correctors, the greater the improvement which is achieved. It has particularly been found that the Q factor (i.e. a measure of the average weighted convergence error at a large number of (for example, 25) measuring points throughout the screen) can be reduced by at least 10% or 20%, and even by at least 50% if a sufficient number of correctors is used.

The dimensions of the correctors are chosen to be such that the required (possibly large) number of correctors can be mounted in an annular support having given dimensions (dictated by the deflection unit with which it must cooperate).

Placing the annular support with the correctors at a position within the deflection coil system is also important, particularly at a position between the centre thereof and the front side. In the case of saddle-type line deflection coils preferably proximate to the front transverse connection portions which interconnect the parts extending in the longitudinal direction of the coil holder.

The latter notably means that the convergence of the electron beams may be influenced at an instant when the electron beams have already been deflected, which is very effective.

The performance of each deflection unit can be measured on a standard display tube and each unit can be provided with a ring having correctors of the strength required for correcting errors caused by spreading. In a suitable measuring method the convergence is measured at, for example, 25 points on the display screen.

An alternative possibility is to measure each deflection unit on the display tube with which it must form a combination, to assemble a ring with correctors on the basis of the measured data, to remove the deflection unit from the display tube so as to place the ring and to put the deflection unit into position again.

It has been found that the operation of matching a display tube with a deflection unit having a ring with correctors according to the invention is easier and hence more rapid than matching a display tube with a deflection unit without such a ring. This is a result of the fact that the error pattern is more regular. (During the matching operation it is attempted, by way of shifting and/or tilting the deflection unit, to correct errors of the combination as much as possible.)

The annular support may be placed on the (glass) envelope of the display tube, i.e. separate from the deflection unit. In an embodiment the annular support is, however, secured to the coil holder. This facilitates handling of the deflection unit. The support may be secured in different manners.

The annular support may have a very thin wall of the order of 1 mm, while compartments having a bottom thickness of between 0.1 and 0.5 mm may have been recessed in this support. The correctors may have the shape of very thin flat discs (comprising, for example a permanent magnetic ferrite material) arranged (for example, glued or clamped) in the compartments in the annular wall and do not, or hardly, extend outside the wall. Since the annular support replaces separately provided preformed elements of similar thickness, the use of the annular support does not involve any or hardly any larger distance between the inner deflection coils and a colour display tube extending within the deflection unit. Dependent on the required correction, the support may be provided with a corrector at one location, with correctors at a plurality of locations, or with correctors at all available locations.

An advantage of the use of preformed elements premagnetized in one direction at different strengths is that the device required for magnetization may be simple. The correctors are preferably magnetized in their plane. To be able to place a sufficiently large number of correctors, the correctors should be sufficiently small. They may have, for example an elongate shape with a largest width of 5 mm and a largest length of 10 mm and placed in such a way that their short or long axis is directed towards the axis of the deflection unit. Their (in-plane) direction of magnetization after positioning in the ring is advantageously directed tangentially. In that case it is possible to form 2N poles along a circular circumference by means of N correctors. The preformed elements used for the correctors may be standard-premagnetized with different values of the magnetic induction (strength). For example, a collection of preformed elements, the strongest of which is ten times as strong as the weakest, such as a collection whose strength varies in steps between roughly 1 and 10 times a given unit strength, or between roughly 1 and 20 (or 24) times a given unit strength. In a practical case the correctors from which a choice is made for positioning in the support have, for example 10 or 20 different strengths in the range between 5 and 500 μT, and more particularly in the range between 5 and 250 μT. The correctors can be placed at the desired locations in the ring in a simple manner by means of an automatic positioning machine. It is then advantageous if the ring has a plurality of positioning projections or grooves in accordance with the number of correctors to be placed.

It is theoretically possible to use a ring of permanent magnetic material and to magnetize this ring at the required (large) number of locations in the desired strength and polarity. However, the required magnetization process is very complicated. The use of an annular support with a large number of (pre)magnetized correctors at fixed locations provides an extremely practical solution to the problem of correcting errors throughout the display screen. Moreover, this provides the possibility of not realising the various strengths in the same magnetic material, but of adapting the composition of the material to the required weaker magnetization for the weaker magnets.

BRIEF DESCRIPTION OF THE DRAWING

These and other aspects of the invention will be apparent from and elucidated with reference to the embodiments described hereinafter. In the drawing.

DESCRIPTION OF THE PREFERRED EMBODIMENTS

Figure 1:
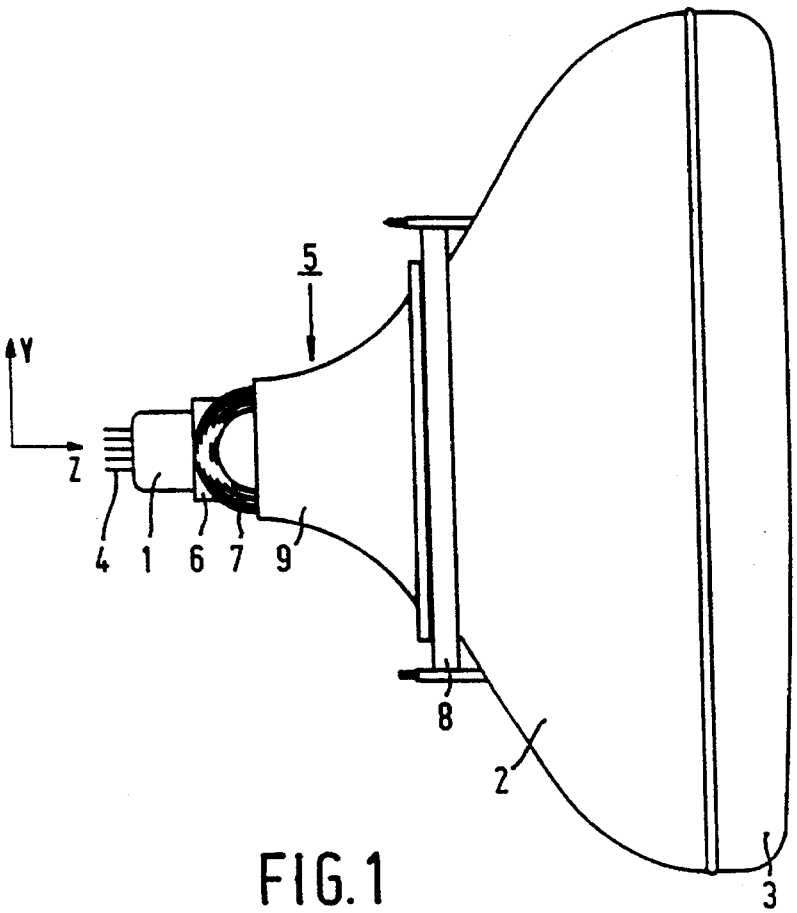
FIG. 1 shows diagmmmatically a colour display tube with a deflection unit in a side elevation.

The colour display tube of FIG. 1 has a neck 1, a cone 2 and a display window 3 with an internal phosphor screen (display screen). Current conductors 4 emerge from the neck 1. A deflection unit 5 is arranged around the neck 1 and against the cone 2. The deflection unit has a coil holder 6 of synthetic material, for example of polystyrene/polyphenylene oxide supporting deflection coils of the saddle type. One deflection coil 7 for (field) deflection of electron beams is visible in this case. A yoke ring 9 of a soft-magnetic material, for example nickel-zinc-ferrite or manganese-zinc-ferrite is arranged around the coils with which it cooperates. The ring 9 is secured to a front flange 8 of the coil holder 6.

Figure 2:
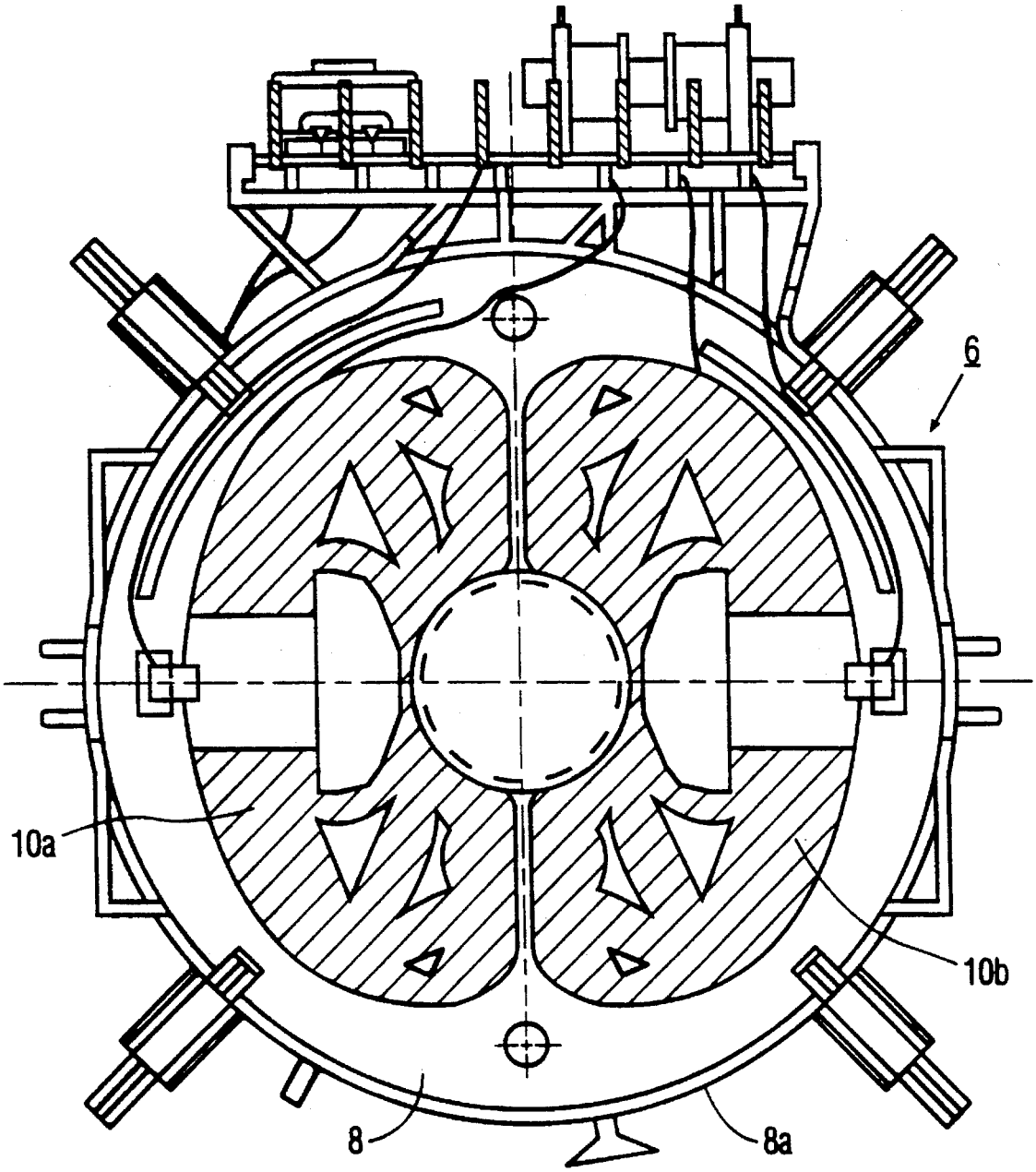
FIG. 2 shows the deflection unit of FIG. 1, viewed from the wide end of the coil holder.

FIG. 2 is a front elevation of the deflection unit 5 with the coil holder 6. Coils 10*a*, 10*b* of the saddle type, intended for, for example line deflection of electron beams, are supported by the coil holder 6. The coils 10*a*, 10*b* have parts which extend substantially in the longitudinal direction of the coil holder 6. These longitudinal parts are connected at their front and rear ends by means of transverse arcuate connection portions. The flange 8, provided with an edge or rim 8*a* at the wide end of the coil holder 6, provides the location for such arcuate connection portions.

Figure 3:
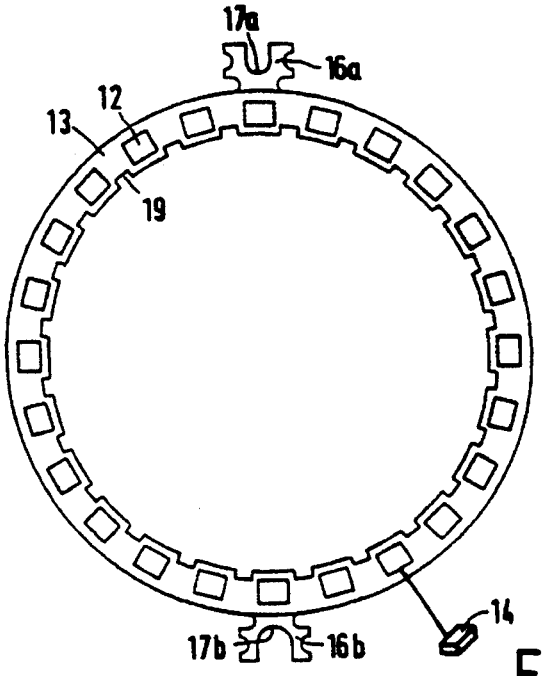
FIG. 3 is a front elevation and FIG. 3A is a cross-section of an annular support with correction magnets.
Figure 3A:
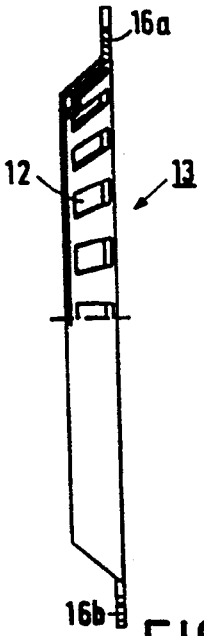

To improve the picture quality throughout the surface of the screen, the invention provides an annular (conical) support 13 (FIG. 3, 3A) in which, in the case shown, 24 compartments 12, . . . are recessed every 15° in the inner surface. Preformed, premagnitized elements 14, which have a length of approximately 6 to 7 mm, a width of approximately 5 mm and a thickness of less than about 1 mm are located in a plurality of the compartments. The required field strength (increasing in, for example 10 or 20 steps from approximately 10 μT to approximately 250 μT) and the direction of magnetization of each magnet position is computed with reference to a test pattern on a display screen for each deflection unit or for each combination of deflection unit and display tube. (A convergence measuring method is described, for example in JP-A 2 156 792 and another method is described in EP-A 135 072.) An embodiment of the support 13 was made of a synthetic material (such as nylon) having a wall thickness of 1 mm; magnetic preformed elements 14 having a thickness of 0.7 mm and comprising a mixture of 60% by volume of polyphenylene oxide/polystyrene and 40% by volume of permanent magnetic ferrite can be connected to the bottoms of the (0–7 mm deep) compartments 24 by means of glueing. The elements 14 were magnetized to produce the desired field strengths at a distance of about 8.4 mm above their centers.

However, the invention is not limited thereto. For example, the ring may alternatively comprise a magnetic inert material which is different from synthetic material, such as glass or a cemmic material. The provision of glue and the positioning of the preformed elements 14 can be realized, for example on an (adapted) S(urface) M(ounting) D(evice) machine. For example, a hot-melt process is suitable for glueing.

Figure 4A:
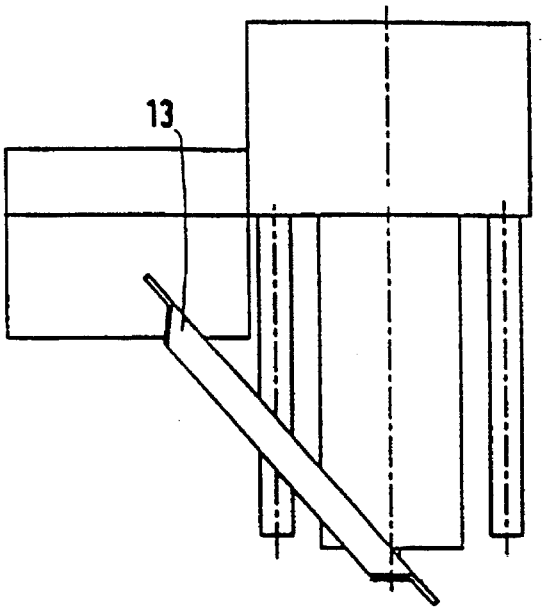
FIG. 4 is a perspective elevational view and FIG. 4A is a cross-section of an annular support during the process of positioning correction magnets.
Figure 4:
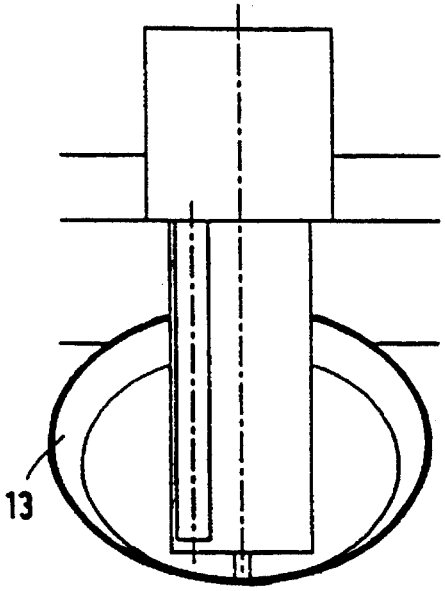

A ring 13 can be given a horizontal position in a positioning machine by means of a conveyor belt. The ring 13 can then be tilted until a processing position has been reached (FIG. 4; FIG. 4A) so that a preformed element 14 can be placed in one position by means of a standard vertical positioning tool. After positioning (and fixation) of a preformed dement 14, the ring 13 is advanced one position. The position is accurately determined and fixed by making use of reference grooves 19 along the inner circumference of ring 13. The positioning routine is repeated until the ring has been filled with the associated preformed elements.

There are, for example 20 types of preformed elements (different in magnetic induction). Each type of preformed element can advantageously be packed in tape and fed to the positioning machine.

Figure 5:
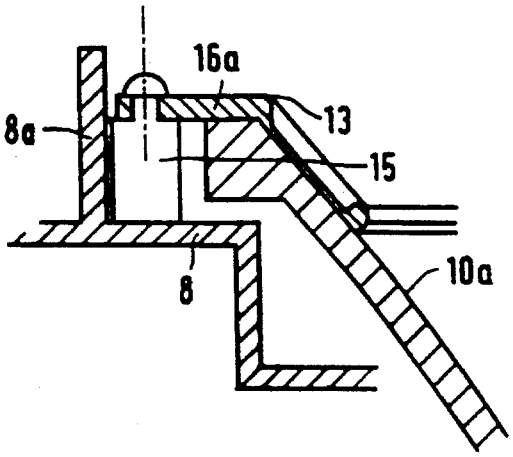
FIG. 5 shows a detail of a coil holder provided with a support with correction magnets.

The ring 13, provided with at least two ears 16*a*, 16*b*, is positioned at the inner side of the line deflection coils 10*a*, 10*b* (FIG. 5) at the wide end of the deflection unit 5. In a preferred embodiment the upper side of the ring 13 registers with the upper side of the deflection coils 10*a*, 10*b*. The ring 13 has a shape which fits in with the shape of the deflection coils 10*a*, 10*b*. The ears 16*a*, 16*b* are used for securing the ring 13 to the front flange 8 of coil holder 6. The ears 16*a*, 16*b* may be secured to a fixation element 15, for example by means of a screw connection, a snap connection (via a clamping fit) or by ultrasonic welding. The ears 16*a*, 16*b* have grooves 17*a*, 17*b* of different dimensions so as to guarantee an unambiguous orientation.

Figure 6:
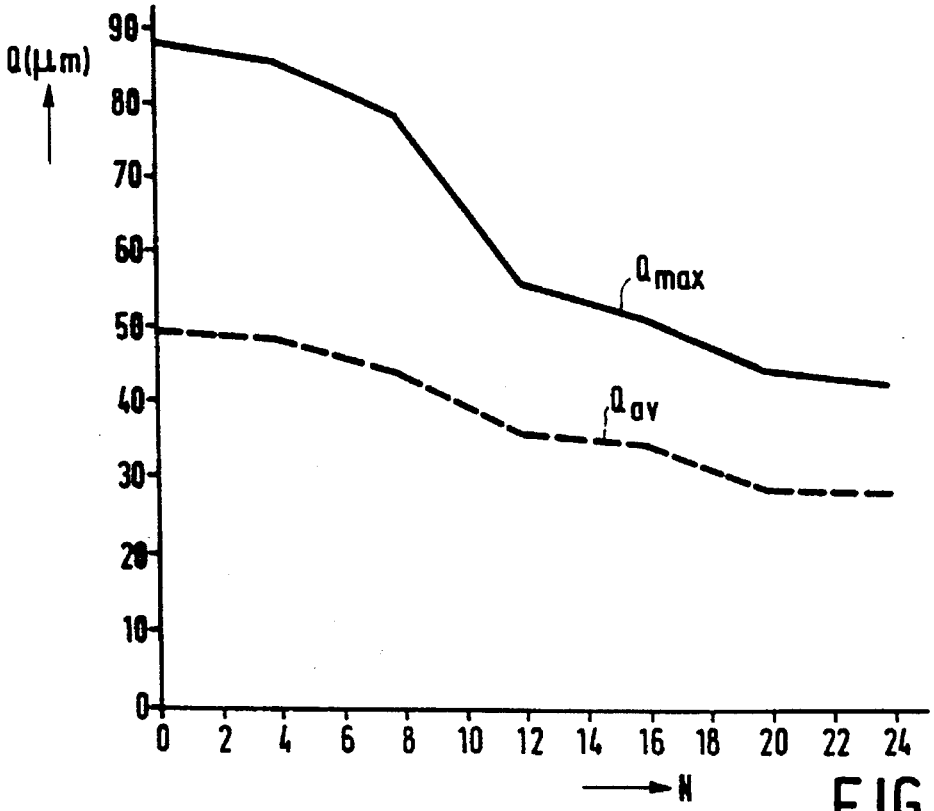
FIG. 6 is a graph showing the Q factor as a function of N.

FIG. 6 shows in a graph $Q_{max}$ ($Q_{max}$ represents the maximum convergence error measured in a series of 100 display tubes) and $Q_{AV}$ (which is a measure of the average weighted convergence error at a large number of measuring points, for example 25, distributed across the screen surface) in dependence upon the number N of correctors positioned at fixed locations in an annular support and on the basis of a measuring and computing program, selected from a collection of correctors having a strength increasing (in steps) from roughly 10 to 200 μT.

FIG. 6 shows with reference to measurements relating to a colour monitor tube that for normal convergence requirements a minimum of 12 corrector locations was needed. For less stringent requirements a number of 8 locations might suffice. Above 36 corrector locations further improvements were found to be marginal.

In practice it is difficult to obtain uniform step sizes, which is related to the geometrical and magnetic tolerances. However, this does not detract from the principle of the invention. For example, a series of magnetized preformed elements having dimensions of 5×7×1 mm had the following values (in μT): 7.5–16.4–26.4–34.8–43.4–50.9–60.5–70.5–80.3–98.6–109.0–118.4–126.7–136.9–146.9–157.1–170.9–178.3–187.5–199.4 upon measurement by means of a Hall gauge and a Gauss meter.

It is to be noted that the annular support used in the invention and having predetermined locations for accommodating field correction elements may not only be used advantageously in deflection units for monochrome or colour display tubes but also in deflection units for electron microscopes, e-beam pattern generators and the like.

It is further to be noted that the collection of premagnetized preformed elements from which a selection is made may have a strength distribution linking up a minimum number of strengths with a maximum number of possibilities, for example a distribution of 1, 2, 5, 10, . . . , a distribution of 1; 1.25; 2; 2.25; 2.75; 3.25; 4; 4.5; 5; 6, . . . , a distribution similar to that of scale weights, etc. More particularly, a very large number of possibilities is created by stacking two or more preformed elements of the same or different strengths having parallel or antiparallel directions of magnetization.

Figure 7:
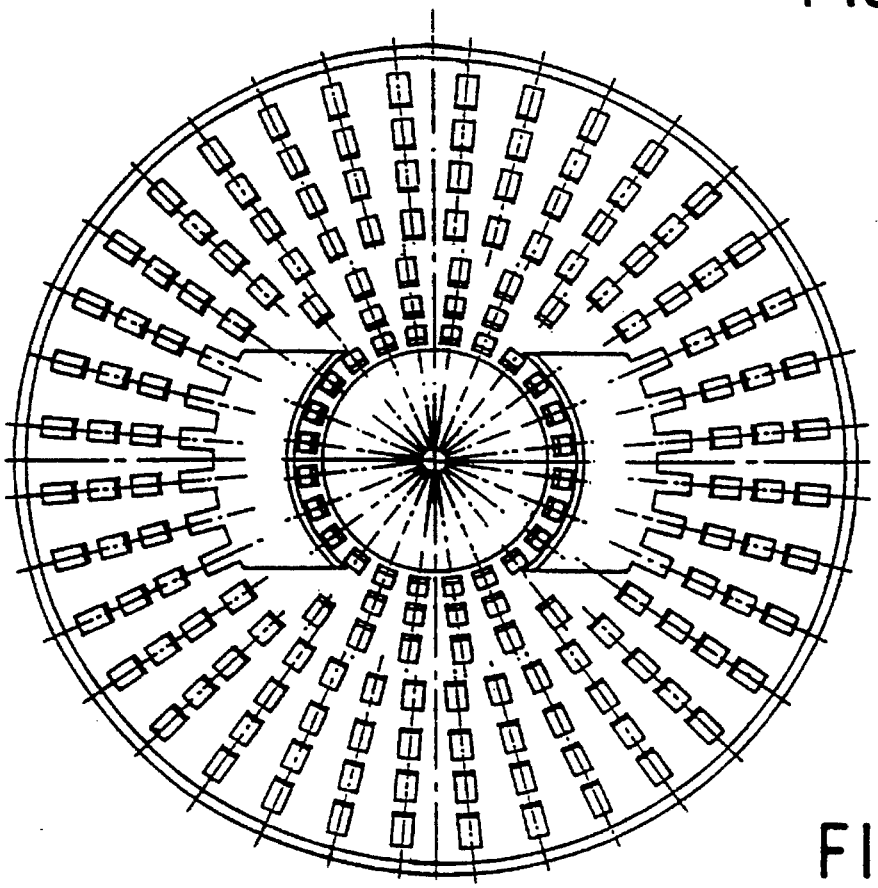
FIG. 7 shows an alternative to the construction of FIG. 3.

FIG. 7 shows by way of example a front view of an annular support in which locations for accommodating correctors are provided on a plurality of radiuses (in this example 7 radiuses). In this example the spacings between the locations on a distinct radius is uniform, but in an alternative embodiment these spacings might be non-uniform.

We claim:

1. An electromagnetic deflection unit for a predetermined type of cathode ray tube, said deflection unit comprising a hollow coil holder substantially surrounding a longitudinal axis and having an inner surface at which is supported an arrangement of coils for producing an electron beam deflection field within said tube, characterized in that said deflection unit includes field correction means for correcting deflection errors of said electron beam, said field correction means comprising:

a. an annular support disposed around the longitudinal axis and within the arrangement of coils, said annular support having a multiplicity of predetermined correction-element-supporting locations;

b. a plurality of magnetized field correction elements, for producing respective magnetic fields, secured at only selected ones of said predetermined locations, said selected locations and said respective magnetic fields being determined for the deflection unit on the basis of at least one measured operating characteristic of said deflection unit.

2. An electromagnetic deflection unit as in claim 1 where each of the correction elements produces a respective magnetic field having a magnetic strength lying in the range of 1 to 1000 μT.

3. An electromagnetic deflection unit as in claim 1 or 2 where each of the correction elements produces a respective magnetic field strength substantially corresponding to one of a number of predetermined selectable values.

4. An electromagnetic deflection unit as in claim 1 or 2 where at least one of the correction elements produces a magnetic field which extends from said correction element in a direction substantially parallel to a plane defined by a surface of said correction element.

5. An electromagnetic deflection unit as in claim 1 or 2 where said at least one correction element produces a magnetic field which extends from said correction element in a direction substantially tangential to a peripheral surface of the annular support.

6. An electromagnetic deflection unit as in claim 1 or 2 where the arrangement of coils includes a coil portion extending transversely of the longitudinal axis and where the annular support is disposed at a longitudinal position which is substantially adjacent to said coil portion.

7. An electromagnetic deflection unit as in claim 1 or 2 where the annular support has from 12 to 36 of said predetermined locations.

8. A color display tube of a predetermined type, said tube including an electromagnetic deflection unit comprising a hollow coil holder substantially surrounding a longitudinal axis and having an inner surface at which is supported an arrangement of coils for producing an electron beam deflection field within said tube, characterized in that said deflection unit includes field correction means for correcting deflection errors of said electron beam, said field correction means comprising:

a. an annular support disposed around the longitudinal axis and within the arrangement of coils, said annular support having a multiplicity of predetermined correction-element-supporting locations; and b. a plurality of magnetized field correction elements, for producing respective magnetic fields, secured at only selected ones of said predetermined locations, said selected locations and said respective magnetic fields being determined for the deflection unit on the basis of at least one measured operating characteristic of said deflection unit.

9. A color display tube as in claim 8 where each of the correction elements produces a respective magnetic field having a magnetic strength lying in the range of 1 to 1000 μT.

10. A color display tube as in claim 8 or 9 where each of the correction elements produces a respective magnetic field strength substantially corresponding to one of a number of predetermined selectable values.

11. A color display tube as in claim 8 or 9 where at least one of the correction elements produces a magnetic field which extends from said correction element in a direction substantially parallel to a plane defined by a surface of said correction element.

12. A color display tube as in claim 8 or 9 where said at least one correction element produces a magnetic field which extends from said correction element in a direction substantially tangential to a peripheral surface of the annular support.

13. A color display tube as in claim 8 or 9 where the arrangement of coils includes a coil portion extending transversely of the longitudinal axis and where the annular support is disposed at a longitudinal position which is substantially adjacent to said coil portion.

14. A color display tube as in claim 8 or 9 where the annular support has from 12 to 36 of said predetermined locations.

15. An electromagnetic deflection unit for a cathode ray tube comprising a hollow coil holder substantially surrounding a longitudinal axis and having an inner surface at which is supported an arrangement of coils for producing an electron beam deflection field within said tube, characterized in that said deflection unit includes field correction means for correcting deflection errors of said electron beam, said field correction means comprising:

a. an annular support disposed around the longitudinal axis and within the arrangement of coils, said annular support having a multiplicity of predetermined correction-element-supporting locations; and b. a plurality of permanent magnet field correction elements, for producing respective magnetic fields, secured at only selected ones of said predetermined locations, said selected locations and said respective magnetic fields being determined for the deflection unit on the basis of at least one measured operating characteristic of said deflection unit.

16. An electromagnetic deflection unit as in claim 15 where at least first and second ones of the correction elements produce magnetic fields having different strengths.

17. An electromagnetic deflection unit as in claim 15 where at least first and second ones of the correction elements produce magnetic fields having different polarities.

18. An electromagnetic deflection unit as in claim 15 where at least first and second ones of the correction elements produce magnetic fields having different strengths and polaraties.

19. An electromagnetic deflection unit as in claim 15 where at least first and second ones of the correction elements are secured at locations which have different distances from said axis.

20. A color display tube comprising an electromagnetic deflection unit comprising a hollow coil holder substantially surrounding a longitudinal axis and having an inner surface at which is supported an arrangement of coils for producing an electron beam deflection field within said tube, characterized in that said deflection unit includes field correction means for correcting deflection errors of said electron beam, said field correction means comprising:

a. an annular support disposed around the longitudinal axis and within the arrangement of coils, said annular support having a multiplicity of predetermined correction-element-supporting locations; and b. a plurality of permanent magnet field correction elements, for producing respective magnetic fields, secured at only selected ones of said predetermined locations, said selected locations and said respective magnetic fields being determined for the deflection unit on the basis of at least one measured operating characteristic of said deflection unit.

21. A color display tube as in claim 20 where at least first and second ones of the correction elements produce magnetic fields having different strengths.

22. A color display tube as in claim 20 where at least first and second ones of the correction elements produce magnetic fields having different polarities.

23. A color display tube as in claim 20 where at least first and second ones of the correction elements produce magnetic fields having different strengths and polaraties.

24. A color display tube as in claim 20 where at least first and second ones of the correction elements are secured at locations which have different distances from said axis.

25. A method of making an electromagnetic deflection unit for a cathode ray tube, of a predetermined type, comprising a hollow coil holder substantially surrounding a longitudinal axis and having an inner surface at which is supported an arrangement of coils for producing an electron beam deflection field within said tube, said method comprising:

a. disposing the deflection unit on a display tube of said predetermined type and operating the tube and the deflection unit to measure a deflection error pattern;

b. providing an annular support having a multiplicity of predetermined correction-element-supporting locations for disposal around the longitudinal axis and within the arrangement of coils;

c. selecting from a multiplicity of permanent magnet field correction elements, which have been respectively magnetized to produce a predetermined variety of different magnetic field strengths, a plurality of said correction elements which are known to substantially correct said error pattern when disposed in known ones of said predetermined locations and oriented in known directions; and d. securing the selected correction elements in the known locations and in the known orientations.

26. An electromagnetic deflection unit as in claim 1 or 15 where the at least one measured operating characteristic comprises an error pattern produced by a cathode ray tube of said predetermined type while said deflection unit is attached.

27. An electromagnetic deflection unit as in claim 26 where said deflection unit has axially-separated first and second ends, said first end being wider than said second end, said annular support being disposed closer to the first end than the second end.

28. An electromagnetic deflection unit as in claim 27 where the annular support is disposed at the first end of the deflection unit.

29. An electromagnetic deflection unit as in claim 26 where at least first and second ones of the field correction elements produce fields of different strengths.

30. A color display tube as in claim 8 or 20 where the at least one measured operating characteristic comprises an error pattern produced by a cathode ray tube of said predetermined type while said deflection unit is attached.

31. A color display tube as in claim 30 where said deflection unit has axially-separated first and second ends, said first end being wider than said second end, said annular support being disposed closer to the first end than the second end.

32. A color display tube as in claim 21 where the annular support is disposed at the first end of the deflection unit.

33. A color display tube as in claim 30 where at least first and second ones of the field correction elements produce fields of different strengths.

* * * * *